US007500509B2

(12) United States Patent
Powell et al.

(10) Patent No.: US 7,500,509 B2
(45) Date of Patent: Mar. 10, 2009

(54) FEEDER ELEMENT FOR METAL CASTING

(75) Inventors: Colin Powell, Birmingham (GB); Jan Sallstrom, Gunnarskog (SE); Jan Eric Pehrsson, Ed (SE)

(73) Assignee: Foseco International Limited, Tamworth, Staffs (GB)

( * ) Notice: Subject to any disclaimer, the term of this patent is extended or adjusted under 35 U.S.C. 154(b) by 649 days.

(21) Appl. No.: 10/521,438

(22) PCT Filed: Oct. 21, 2004

(86) PCT No.: PCT/GB2004/004451

§ 371 (c)(1),
(2), (4) Date: Jan. 14, 2005

(87) PCT Pub. No.: WO2005/051568

PCT Pub. Date: Jun. 9, 2005

(65) Prior Publication Data

US 2005/0236132 A1 Oct. 27, 2005

(30) Foreign Application Priority Data

Oct. 28, 2003 (GB) ..... 0325134.5

(51) Int. Cl.
*B22C 9/08* (2006.01)

(52) U.S. Cl. ..... 164/359; 164/360

(58) Field of Classification Search ..... 164/359, 164/360

See application file for complete search history.

(56) References Cited

U.S. PATENT DOCUMENTS

2004/0050526 A1 * 3/2004 Skerdi et al. ..... 164/359

FOREIGN PATENT DOCUMENTS

| | | |
|---|---|---|
| DE | 3252637 A1 | 1/1987 |
| DE | 295 13 017 U1 | 1/1996 |
| DE | 19642838 A1 | 7/1997 |
| DE | 201 12 425 U 1 | 11/2001 |
| DE | 201 15 140 U 1 | 3/2002 |
| DE | 20 2004 009367 U1 | 9/2004 |
| EP | 1 184 104 A1 | 3/2002 |
| JP | 49-118620 | 11/1974 |

* cited by examiner

*Primary Examiner*—Kuang Lin
(74) *Attorney, Agent, or Firm*—Nixon & Vanderhye

(57) ABSTRACT

The present invention relates to a feeder element (10) for use in metal casting. The feeder element (10) (which serves the function of a breaker core) has a first end (16) for mounting on a mould plate (24), an opposite second end (18) for receiving a feeder sleeve (20) and a bore (14) between the first and second ends (16,18) defined by a sidewall (12). The feeder element (10) is compressible in use whereby to reduce the distance between said first and second ends (16,18).

The invention also relates to a breaker core/feeder sleeve assembly (10,20).

22 Claims, 10 Drawing Sheets

FEEDER ELEMENT FOR METAL CASTING

This application is the U.S. National Phase of International Application PCT/GB04/004451 filed 21 Oct. 2004, which designated the U.S. PCT/GB04/004451 claims priority to British Application No. 0325134.5 filed 28 Oct. 2003. The entire content of these applications are incorporated herein by reference.

The present invention relates to an improved feeder element for use in metal casting operations utilising casting moulds, especially but not exclusively in high-pressure sand moulding systems.

BACKGROUND OF THE INVENTION

In a typical casting process, molten metal is poured into a pre-formed mould cavity which defines the shape of the casting. However, as the metal solidifies it shrinks, resulting in shrinkage cavities which in turn result in unacceptable imperfections in the final casting. This is a well known problem in the casting industry and is addressed by the use of feeder sleeves or risers which are integrated into the mould during mould formation. Each feeder sleeve provides an additional (usually enclosed) volume or cavity which is in communication with the mould cavity, so that molten metal also enters into the feeder sleeve. During solidification, molten metal within the feeder sleeve flows back into the mould cavity to compensate for the shrinkage of the casting. It is important that metal in the feeder sleeve cavity remains molten longer than the metal in the mould cavity, so feeder sleeves are made to be highly insulating or more usually exothermic, so that upon contact with the molten metal additional heat is generated to delay solidification.

After solidification and removal of the mould material, unwanted residual metal from within the feeder sleeve cavity remains attached to the casting and must be removed. In order to facilitate removal of the residual metal, the feeder sleeve cavity may be tapered towards its base (i.e. the end of the feeder sleeve which will be closest to the mould cavity) in a design commonly referred to as a neck down sleeve. When a sharp blow is applied to the residual metal it separates at the weakest point which will be near to the mould (the process commonly known as "knock off"). A small footprint on the casting is also desirable to allow the positioning of feeder sleeves in areas of the casting where access may be restricted by adjacent features.

Although feeder sleeves may be applied directly onto the surface of the mould cavity, they are often used in conjunction with a breaker core. A breaker core is simply a disc of refractory material (typically a resin bonded sand core or a ceramic core or a core of feeder sleeve material) with a hole in its centre which sits between the mould cavity and the feeder sleeve. The diameter of the hole through the breaker core is designed to be smaller than the diameter of the interior cavity of the feeder sleeve (which need not necessarily be tapered) so that knock off occurs at the breaker core close to the mould.

Casting moulds are commonly formed using a moulding pattern which defines the mould cavity. Pins are provided on the pattern plate at predetermined locations as mounting points for the feeder sleeves. Once the required sleeves are mounted on the pattern plate, the mould is formed by pouring moulding sand onto the pattern plate and around the feeder sleeves until the feeder sleeves are covered. The mould must have sufficient strength to resist erosion during the pouring of molten metal, to withstand the ferrostatic pressure exerted on the mould when full and to resist the expansion/compression forces when the metal solidifies.

Moulding sand can be classified into two main categories. Chemical bonded (based on either organic or inorganic binders) or clay-bonded. Chemically bonded moulding binders are typically self-hardening systems where a binder and a chemical hardener are mixed with the sand and the binder and hardener start to react immediately, but sufficiently slowly enough to allow the sand to be shaped around the pattern plate and then allowed to harden enough for removal and casting.

Clay-bonded moulding uses clay and water as the binder and can be used in the "green" or undried state and is commonly referred to as greensand. Greensand mixtures do not flow readily or move easily under compression forces alone and therefore to compact the greensand around the pattern and give the mould sufficient strength properties as detailed previously, a variety of combinations of jolting, vibrating, squeezing and ramming are applied to produce uniform strength moulds at high productivity. The sand is typically compressed (compacted) at high pressure, usually using a hydraulic ram (the process being referred to as "ramming up"). With increasing casting complexity and productivity requirements, there is a need for more dimensionally stable moulds and the tendency is towards higher ramming pressures which can result in breakage of the feeder sleeve and/or breaker core when present, especially if the breaker core or the feeder sleeve is in direct contact with the pattern plate prior to ram up.

The above problem is partly alleviated by the use of spring pins. The feeder sleeve and optional locator core (similar in composition and overall dimensions to breaker cores) is initially spaced from the pattern plate and moves towards the pattern plate on ram up. The spring pin and feeder sleeve may be designed such that after ramming, the final position of the sleeve is such that it is not in direct contact with the pattern plate and may be typically 5 to 25 mm distant from the pattern surface. The knock off point is often unpredictable because it is dependent upon the dimensions and profile of the base of the spring pins and therefore results in additional cleaning costs. Other problems associated with spring pins are explained in EP-A-1184104. The solution offered in EP-A-1184104 is a two-part feeder sleeve. Under compression during mould formation, one mould (sleeve) part telescopes into the other. One of the mould (sleeve) parts is always in contact with the pattern plate and there is no requirement for a spring pin. However, there are problems associated with the telescoping arrangement of EP-A-1184104. For example, due to the telescoping action, the volume of the feeder sleeve after moulding is variable and dependent on a range of factors including moulding machine pressure, casting geometry and sand properties. This unpredictability can have a detrimental effect on feed performance. In addition, the arrangement is not ideally suited where exothermic sleeves are required. When exothermic sleeves are used, direct contact of exothermic material with the casting surface is undesirable and can result in poor surface finish, localised contamination of the casting surface and even sub-surface gas defects.

Yet a further disadvantage of the telescoping arrangement of EP-A-1184104 arises from the tabs or flanges which are required to maintain the initial spacing of the two mould (sleeve) parts. During moulding, these small tabs break off (thereby permitting the telescoping action to take place) and simply fall into the moulding sand. Over a period of time, these pieces will build up in the moulding sand. The problem is particularly acute when the pieces are made from exothermic material. Moisture from the sand can potentially react with the exothermic material (e.g. metallic aluminium) creating the potential for small explosive defects.

SUMMARY OF THE INVENTION

It is an object of the present invention in a first aspect to provide an improved feeder element which can be used in a cast moulding operation. In particular, it is an object of the present invention in its first aspect to provide a feeder element which offers one or more (and preferably all) of the following advantages:

(i) a smaller feeder element contact area (aperture to the casting)

(ii) a small footprint (external profile contact) on the casting surface;

(iii) reduced likelihood of feeder sleeve breakage under high pressures during mould formation; and (iv) consistent knock off with significantly reduced cleaning requirements.

A further object of the present invention is to obviate or mitigate one or more of the disadvantages associated with the two-part telescoping feeder sleeve disclosed in EP-A-1184104.

An object of a second aspect of the present invention is to provide an alternative feeder system to that proposed in EP-A-1184104.

According to a first aspect of the present invention, there is provided a feeder element for use in metal casting, said feeder element having a first end for mounting on a mould pattern (plate), an opposite second end for receiving a feeder sleeve and a bore between the first and second ends defined by a sidewall, said feeder element being compressible in use whereby to reduce the distance between said first and second ends.

It will be understood that the amount of compression and the force required to induce compression will be influenced by a number of factors including the material of manufacture of the feeder element and the shape and thickness of the sidewall. It will be equally understood that individual feeder elements will be designed according to the intended application, the anticipated pressures involved and the feeder size requirements. Although the invention has particular utility in high volume high-pressure moulding systems, it is also useful in lower pressure applications (when configured accordingly) such as hand rammed casting moulds.

Preferably, the initial crush strength (i.e. the force required to initiate compression and irreversibly deform the feeder element over and above the natural flexibility that it has in its unused and uncrushed state) is no more than 5000 N, and more preferably no more than 3000 N. If the initial crush strength is too high, then moulding pressure may cause the feeder sleeve to fail before compression is initiated. Preferably, the initial crush strength is at least 500 N. If the crush strength is too low, then compression of the element may be initiated accidentally, for example if a plurality of elements are stacked for storage or during transport.

The feeder element of the present invention may be regarded as a breaker core as this term suitably describes some of the functions of the element in use. Traditionally, breaker cores comprise resin bonded sand or are a ceramic material or a core of feeder sleeve material. However, the feeder element of the current invention can be manufactured from a variety of other suitable materials. In certain configurations it may be more appropriate to consider the feeder element to be a feeder neck.

As used herein, the term "compressible" is used in its broadest sense and is intended only to convey that the length of the feeder element between its first and second ends is shorter after compression than before compression. Preferably, said compression is non-reversible i.e. it is important that after removal of the compression inducing force the feeder element does not revert to its original shape. Compression may be achieved through the inherent compressibility of the material from which the feeder element is formed, e.g. rubber or other polymeric material. Thus, in a first embodiment, the feeder element is a rubber tube.

Alternatively, compression may be achieved through the deformation of a non-brittle material such as a metal (e.g. steel, aluminium, aluminium alloys, brass etc) or plastic. In a second embodiment, the sidewall of the feeder element is provided with one or more weak points which are designed to deform (or even shear) under a predetermined load (corresponding to the crush strength).

The sidewall may be provided with at least one region of reduced thickness which deforms under a predetermined load. Alternatively or in addition, the sidewall may have one or more kinks, bends, corrugations or other contours which cause the sidewall to deform under a predetermined load (corresponding to the crush strength).

In a third embodiment, the bore is frustoconical and bounded by a sidewall having at least one circumferential groove. Said at least one groove may be on an interior or (preferably) exterior surface of the sidewall and provides in use a weak point which deforms or shears predictably under an applied load (corresponding to the crush strength).

In a particularly preferred embodiment, the feeder element has a stepped sidewall which comprises a first series of sidewall regions in the form of rings (which are not necessarily planar) of increasing diameter interconnected and integrally formed with a second series of sidewall regions. Preferably, the sidewall regions are of substantially uniform thickness, so that the diameter of the bore of the feeder element increases from the first end to the second end of the feeder element. Conveniently, the second series of sidewall regions are annular (i.e. parallel to the bore axis), although they may be frustoconical (i.e. inclined to the bore axis). Both series of sidewall regions may be of non-circular shape (e.g. oval, square, rectangular, or star shaped).

The compression behaviour of the feeder element can be altered by adjusting the dimensions of each wall region. In one embodiment, all of the first series of sidewall regions have the same length and all of the second series of sidewall regions have the same length (which may be the same as or different to the first series of sidewall regions). In a preferred embodiment however, the length of the first series of sidewall regions varies, the wall regions towards the second end of the feeder element being longer than the sidewall regions towards the first end of the feeder element.

The feeder element may be defined by a single ring between a pair of sidewall regions of the second series. However, the feeder element may have as many as six or more of each of the first and the second series of sidewall regions.

Preferably, the angle defined between the bore axis and the first sidewall regions (especially when the second sidewall regions are parallel to the axis of the bore) is from about 55 to 90° and more preferably from about 70 to 90°. Preferably, the thickness of the sidewall regions is from about 4 to 24%, preferably from about 6 to 20%, more preferably from about 8 to 16% of the distance between the inner and outer diameters of the first sidewall regions (i.e. the annular thickness in the case of planar rings (annuli)).

Preferably, the distance between the inner and outer diameters of the first series of sidewall regions is 4 to 10 mm and most preferably 5 to 7.5 mm. Preferably, the thickness of the sidewall regions is 0.4 to 1.5 mm and most preferably 0.5 to 1.2 mm.

In general, each of the sidewalls within the first and second series will be parallel so that the angular relationships described above apply to all the sidewall regions. However, this is not necessarily the case and one (or more) of the sidewall regions may be inclined at a different angle to the bore axis to the others of the same series, especially where the sidewall region defines the first end (base) of the feeder element.

In a convenient embodiment, only an edge contact is formed between the feeder element and casting, the first end (base) of the feeder element being defined by a sidewall region of the first or second series which is non-perpendicular to the bore axis. It will be appreciated from the foregoing discussion that such an arrangement is advantageous in minimising the footprint and contact area of the feeder element. In such embodiments, the sidewall region which defines the first end of the feeder element may have a different length and/or orientation to the other sidewall regions of that series. For example, the sidewall region defining the base may be inclined to the bore axis at an angle of 5 to 30°, preferably 5 to 15°. Preferably, the free edge of the sidewall region defining the first end of the feeder element has an inwardly directed annular flange or bead.

Conveniently, a sidewall region of the first series defines the second end of the feeder element, said sidewall region preferably being perpendicular to the bore axis. Such an arrangement provides a suitable surface for mounting of a feeder sleeve in use.

It will be understood from the foregoing discussion that the feeder element is intended to be used in conjunction with a feeder sleeve. Thus, the invention provides in a second aspect a feeder system for metal casting comprising a feeder element in accordance with the first aspect and secured thereto a feeder sleeve.

The nature of the feeder sleeve is not particularly limited and it may be for example insulating, exothermic or a combination of both, for example one sold by Foseco under the trade name KALMIN, FEEDEX or KALMINEX. The feeder sleeve may be conveniently secured to the feeder element by adhesive but may also be push fit or have the sleeve moulded around part of the feeder element.

BRIEF DESCRIPTION OF THE DRAWINGS

Embodiments of the invention will now be described by way of example only with reference to the accompanying drawings in which.

DETAILED DESCRIPTION OF PREFERRED EMBODIMENTS

Figure 1:
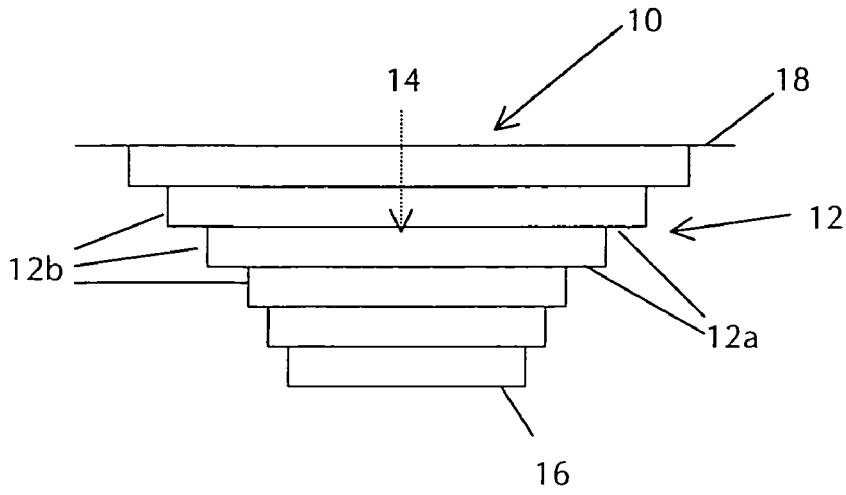
FIGS. 1 and 2 are side and top elevations respectively of a first feeder element in accordance with the present invention.
Figure 2:
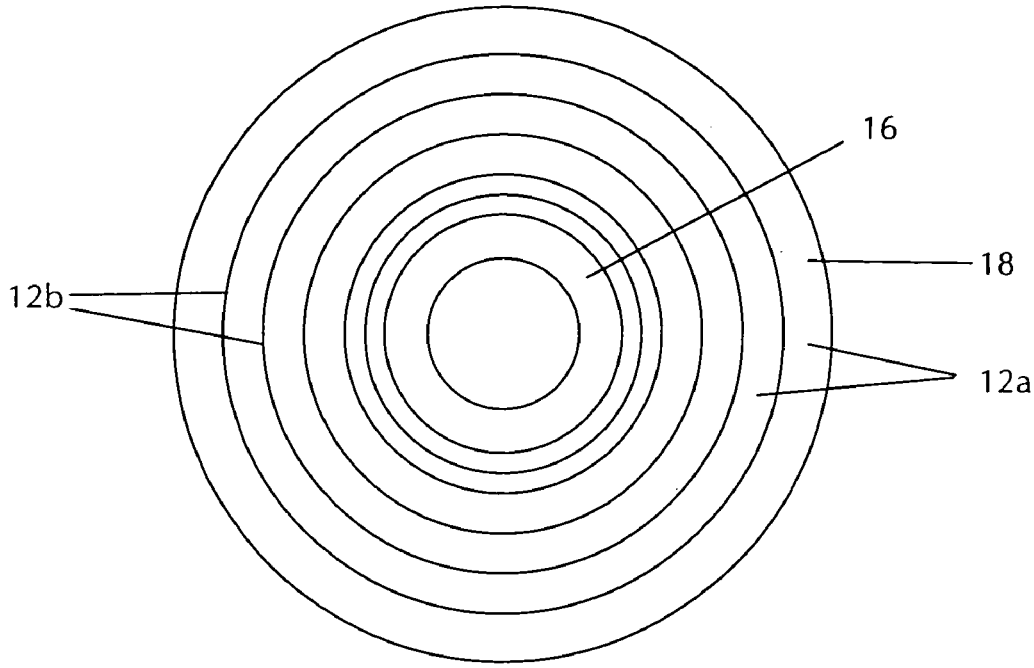

Referring to FIGS. 1 and 2, a feeder element in the form of a breaker core 10 has a generally frustoconical sidewall 12 formed by pressing sheet steel. An inner surface of the sidewall 12 defines a bore 14 which extends through the breaker core 10 from its first end (base) 16 to its second end (top) 18, the bore 14 being of smaller diameter at the first end 16 than at the second end 18. The sidewall 12 has a stepped configuration and comprises an alternating series of first and second sidewall regions 12*a*, 12*b*. The sidewall 12 can be regarded as a (first) series of mutually spaced annuli or rings 12*a* (of which there are seven), each annulus 12*a* having an inner diameter corresponding to the outer diameter of the preceding annulus 12*a*, with adjacent annuli 12*a* being interconnected by an annular sidewall region of the second series 12*b* (of which there are six). The sidewall regions 12*a*, 12*b* are more conveniently described with reference to the longitudinal axis of the bore 14, the first series of sidewall regions 12*a* being radial (horizontal as shown) sidewall regions and the second series of sidewall regions 12*b* being axial (vertical as shown) sidewall regions. The angle $\alpha$ between the bore axis and the first sidewall regions 12*a* (in this case also the angle between adjacent pairs of sidewall regions) is 90°. Radial sidewall regions 12*a* define the base 16 and the top 18 of the breaker core 10. In the embodiment shown, the axial sidewall regions 12*b* all have the same height (distance from inner diameter to outer diameter), whereas the bottom two radial sidewall regions 12*a* have a reduced annular thickness (radial distance between inner and outer diameters). The outer diameter of the radial sidewall region defining the top 18 of the breaker core 10 is chosen according to the dimensions of the feeder sleeve to which it is to be attached (as will be described below). The diameter of the bore 14 at the first end 16 of the breaker core 10 is designed to be a sliding fit with a fixed pin.

Figure 3:
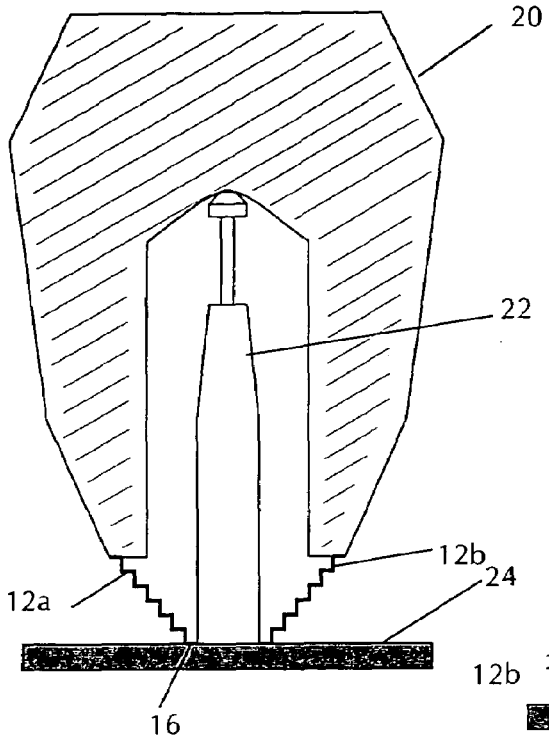
FIGS. 3 and 4 show the feeder element of FIG. 1 and a feeder sleeve mounted on a spring pin before and after ram up respectively.
Figure 3A:
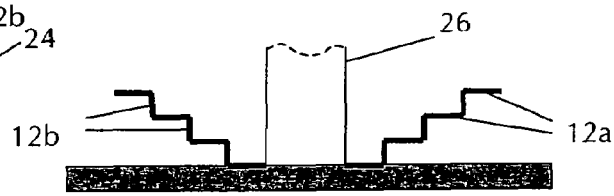
FIG. 3A is a cross section of part of the assembly of FIG. 3.

Referring to FIG. 3, the breaker core 10 of FIG. 1 is attached by adhesive to a feeder sleeve 20, the breaker core/feeder sleeve assembly being mounted on a spring pin 22 secured to a pattern plate 24. The radial sidewall region 12*a* forming the base 16 of the breaker core 10 sits on the pattern plate 24 (FIG. 3A). In a modification (not shown), the top 18 of the breaker core 10 is provided with a series of through-holes (for example six evenly spaced circular holes). The breaker core 10 is secured to the feeder sleeve 20 by the application of adhesive (e.g. hot melt adhesive) applied between the two parts. When pressure is applied, adhesive is partially squeezed out through the holes and sets. This set adhesive serves as rivets to hold together the breaker core 10 and feeder sleeve 20 more securely.

Figure 4:
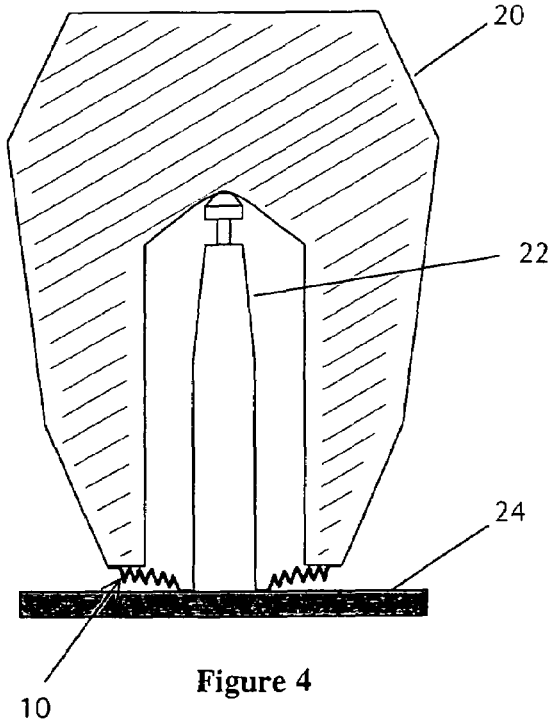

In use, the feeder sleeve assembly is covered with moulding sand (which sand also enters the volume around the breaker core 10 below the feeder sleeve 20) and the pattern plate 24 is "rammed up" whereby to compress the moulding sand. The compressive forces cause the sleeve 20 to move downwardly towards the pattern plate 24. The forces are partially absorbed by the pin 22 and partially by the deformation or collapse of the breaker core 10 which effectively acts as a crumple zone for the feeder sleeve 20. At the same time, the moulding medium (sand) trapped under the deforming breaker core 10 is also progressively compacted to give the required mould hardness and surface finish below the breaker core 10 (this feature is common to all embodiments in which the downwardly tapering shape of the feeder element permits moulding sand to be trapped directly below the feeder sleeve). In addition, compaction of the sand also helps to absorb some of the impact. It will be understood that since the base 16 of the breaker core 10 defines the narrowest region in communication with the mould cavity, there is no requirement for the feeder sleeve 20 to have a tapered cavity or excessively tapering sidewalls which might reduce its strength. The situation after the ram up is shown in FIG. 4. Casting is effected after removal of the pattern plate 24 and pin 22.

Figure 5:
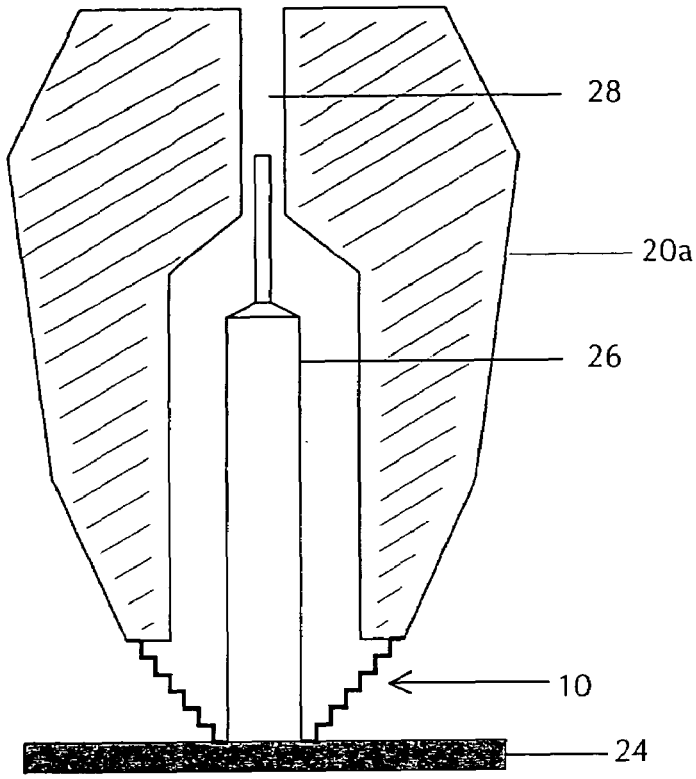
FIGS. 5 and 6 show the feeder element of FIG. 1 and a feeder sleeve mounted on a fixed pin before and after ram up respectively.
Figure 6:
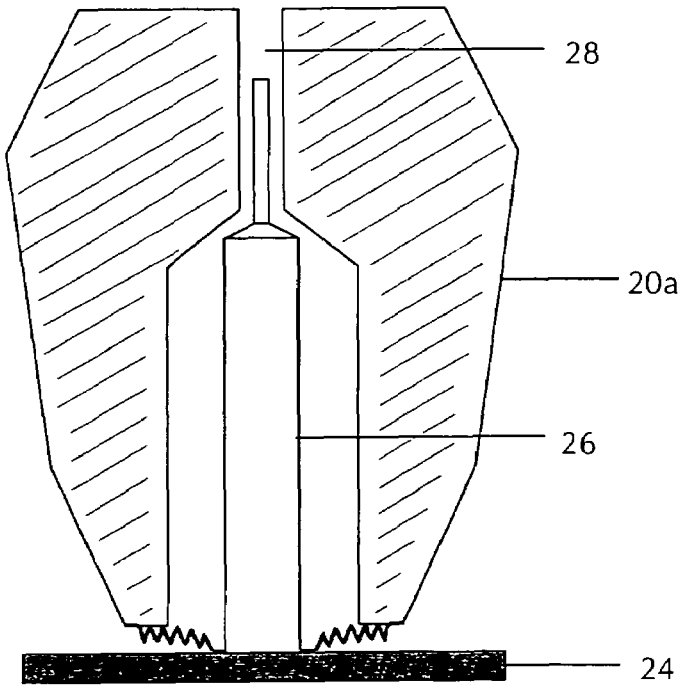
Figure 24:
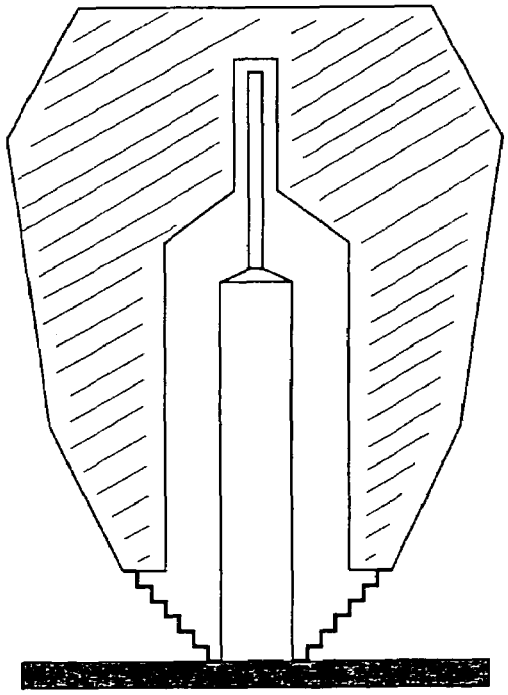
FIGS. 24 and 25 show the feeder element of FIG. 1 and a different feeder sleeve to that shown in FIGS. 5 and 6 mounted on a fixed pin before and after ram up respectively.
Figure 25:
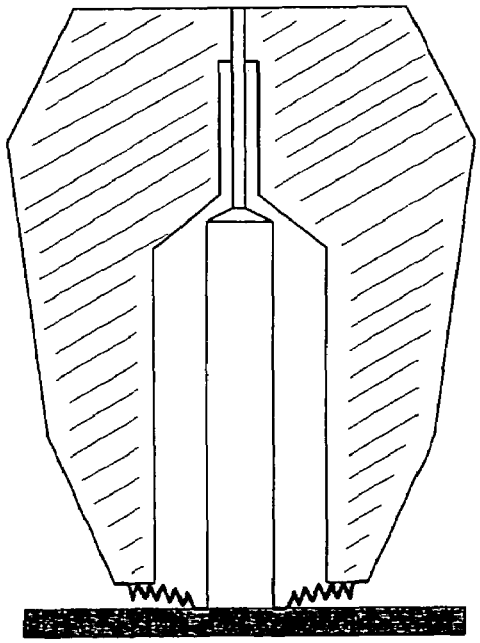

Advantageously, the feeder element of the present invention does not depend on the use of a spring pin. FIGS. 5 and 6 illustrate the breaker core 10 fitted to a feeder sleeve 20*a* mounted on a fixed pin 26. Since on ram up (FIG. 6), the sleeve 20*a* moves downwardly and the pin 26 is fixed, the sleeve 20*a* is provided with a bore 28 within which the pin 26 is received. As shown, the bore 28 extends through the top surface of the sleeve 20*a*, although it will be understood that in other embodiments (not shown) the sleeve may be provided with a blind bore (i.e. the bore extends only partially through the top section of the feeder so that the riser sleeve cavity is enclosed). In a further variation (shown in FIG. 24) a blind bore is used in conjunction with a fixed pin, the sleeve being designed so that on ram up the pin pierces the top of the feeder sleeve as shown in FIG. 25 (and described in DE 19503456), thus creating a vent for mould gasses once the pin is removed.

Figure 7:
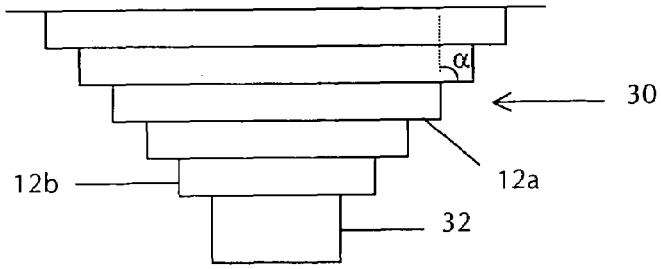
FIGS. 7 and 8 are side and top elevations respectively of a second feeder element in accordance with the present invention.
Figure 8:
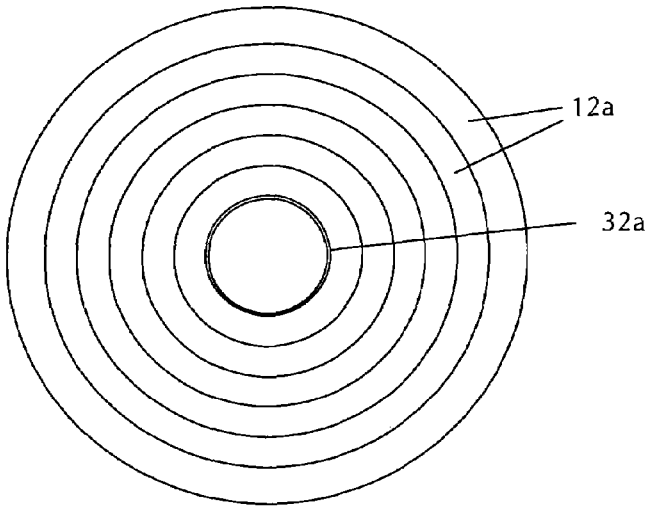
Figure 7A:
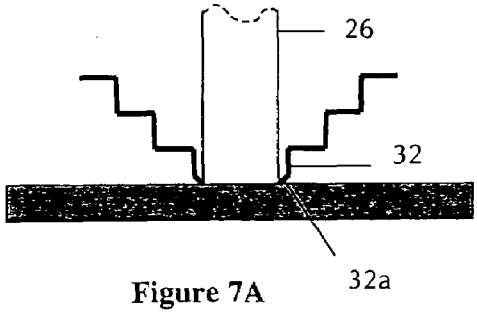
FIGS. 7A and 7B are cross sections of part of the feeder element of FIG. 7 mounted on a standard pin and a modified pin respectively.

Referring to FIGS. 7 and 8, the breaker core 30 shown differs from that illustrated in FIG. 1 in that the sidewall region 32 defining the base of the breaker core 30 is axially orientated and its diameter corresponds substantially to the diameter of the pin 22,26. This axial sidewall region 32 is also extended to have a greater height than the other axial sidewall regions 12*b*, to allow for some depth of compacted sand below the breaker core 30. In addition, the free edge of the axial sidewall region 32 defining the base has an inwardly orientated annular flange 32*a* which sits on the pattern plate in use and which strengthens the lower edge of the bore and increases the contact area to the pattern plate 24 (ensuring that the base of the breaker core 30 does not splay outwardly under compression), produces a defined notch in the feeder neck to aid knock off and ensures the knock off is close to the casting surface. The annular flange also provides for an accurate location on the pin whilst allowing free play between it and the axial sidewall region 32. This is seen more clearly in FIG. 7A from which it can be seen that there is only an edge contact between the pattern plate 24 and the breaker core 30, thereby minimising the footprint of the feeder element. The remaining axial and radial sidewall regions 12*a*, 12*b* have the same length/height.

Figure 7B:
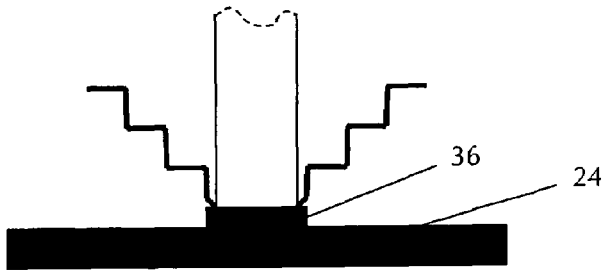

The knock off point is so close to the casting that in certain extreme circumstances it may be possible for the breaker core 30 to break off into the casting surface. Referring therefore to FIG. 7B, it may be desirable to provide a short (about 1 mm) stub 36 at the base of the pin (fixed or spring) on which the breaker core 30 sits. This is conveniently achieved by forming the pattern plate 24 with a suitably raised region on which the pin is mounted. Alternatively, the stub may be in the form of a ring formed either as part of the pattern plate 24, at the base of the pin, or as a discrete member (e.g. a washer) which is placed over the pin before the breaker core 30 is mounted on the pin.

Figure 9:
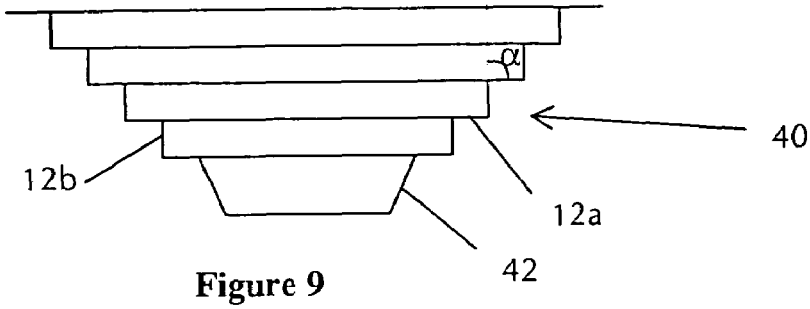
FIGS. 9 and 10 are side and top elevations respectively of a third feeder element in accordance with the present invention.
Figure 10:
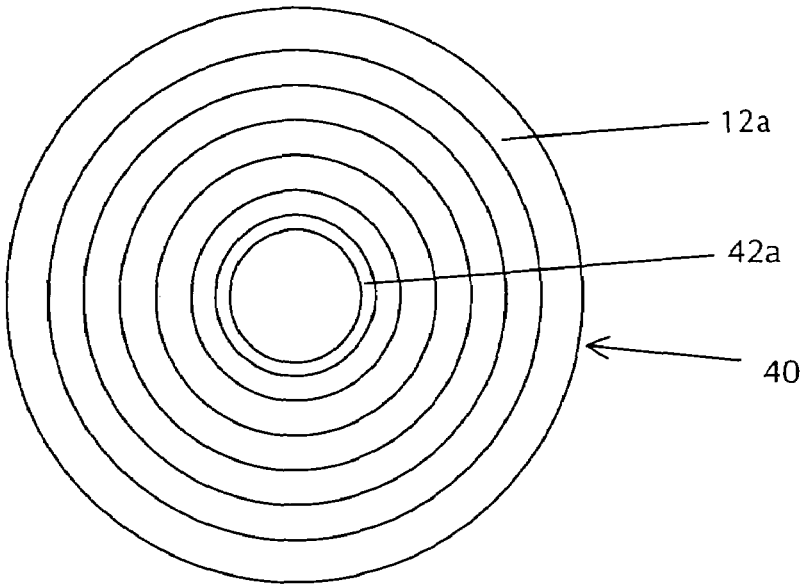

Referring to FIGS. 9 and 10, a further breaker core 40 in accordance with the invention is substantially the same as that shown in FIGS. 7 and 8, except that the sidewall 42 defining the base of the breaker core 40 is frustoconical, tapering axially outwardly from the base of the breaker core at an angle of about 20° to 30° to the bore axis. The sidewall 42 is provided with an annular flange 42*a* in the same manner and for the same purpose as the embodiment shown in FIG. 7. The breaker core 40 has one fewer step (i.e. one fewer axial and radial sidewall region 12*a*, 12*b*) than the breaker core 30 shown in FIG. 7.

Figure 11:
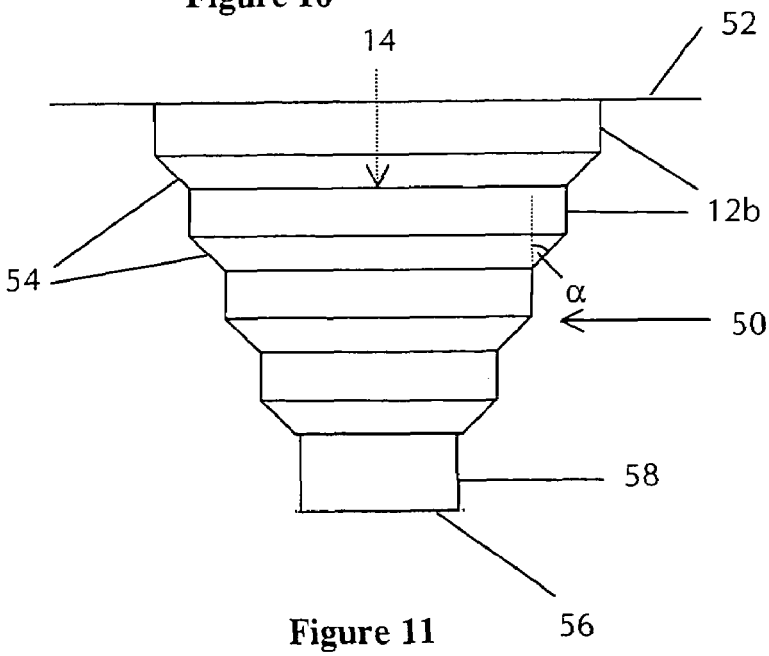
FIG. 11 is a side elevation of a fourth feeder element in accordance with the present invention.

Referring to FIG. 11, a further breaker core 50 in accordance with the invention is shown. The basic configuration is similar to that of the previously described embodiment. The pressed metal sidewall is stepped to provide a bore 14 of increasing diameter towards the second (top) end 52 of the breaker core 50. In this embodiment however, the first series of sidewall regions 54 are inclined by about 45° to the bore axis (i.e. frustoconical) so that they are outwardly flared relative to the base 56 of the breaker core 50. The angle $\alpha$ between the sidewall regions 54 and the bore axis is also 45°. This embodiment has the preferred feature that the first series of radial sidewall regions 54 are the same length as the axial sidewall regions 12*b* such that on compression the profile of the resultant deformed feeder element is relatively level (horizontal). The breaker core 50 comprises only four axial sidewall regions 54 of the first series. The sidewall region 58 of the second series 12*b* terminates at the base 56 of the breaker core 50 and is significantly longer than the other sidewall regions 12*b* of the second series.

Figure 12:
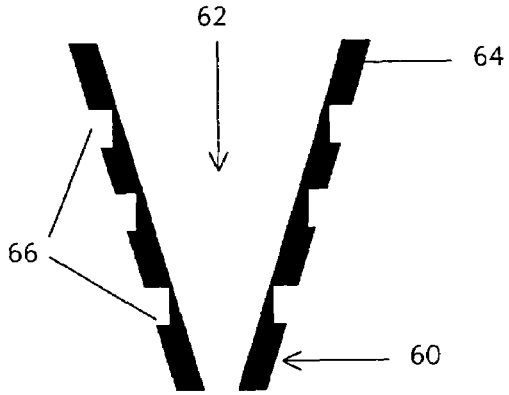
FIGS. 12 and 13 are cross sections of a fifth feeder element in accordance with the present invention before and after compression respectively.
Figure 13:
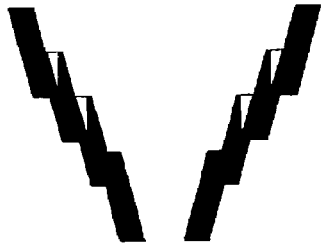

Referring to FIGS. 12 and 13, a further breaker core 60 is shown. The breaker core 60 has a frustoconical bore 62 defined by a metal sidewall 64 of substantially uniform thickness into an external surface of which three mutually spaced concentric grooves 66 have been provided (in this case by machining). The grooves 66 introduce weak points into the sidewall 64 which fail predictably on compression (FIG. 13). In variations of this embodiment (not shown) a series of discrete notches is provided. Alternatively, the sidewall is formed with alternating relatively thick and relatively thin regions.

Figure 14:
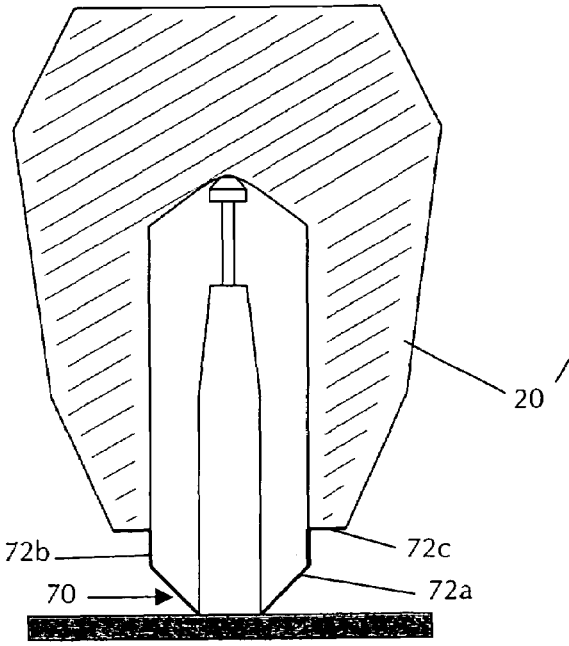
FIGS. 14 and 15 are cross-sectional schematics of a feeder assembly incorporating a sixth feeder element in accordance with the present invention before and after compression respectively.
Figure 15:
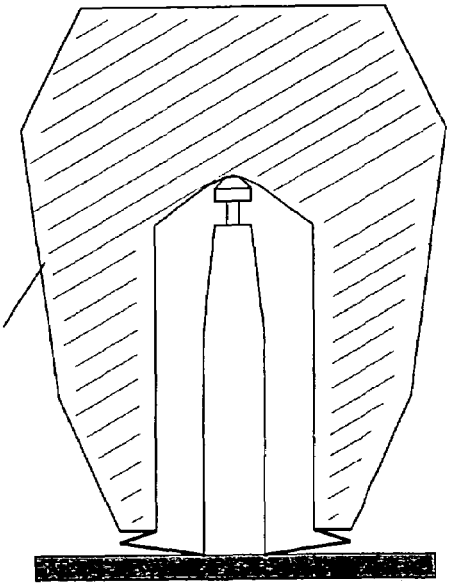

A yet further breaker core in accordance with the present invention is shown in FIGS. 14 and 15. The breaker core 70 is a thin side walled steel pressing. From its base, the sidewall has an outwardly flared first region 72*a*, a tubular, axially orientated second region 72*b* of circular cross section, and a third radially outwardly extending region 72*c*, the third region 72*c* serving as a seat for a feeder sleeve 20 in use. Under compression, the breaker core 70 collapses in a predictable manner (FIG. 15), the internal angle between the first and second sidewall regions 72*a*, 72*b* decreasing.

Figure 16:
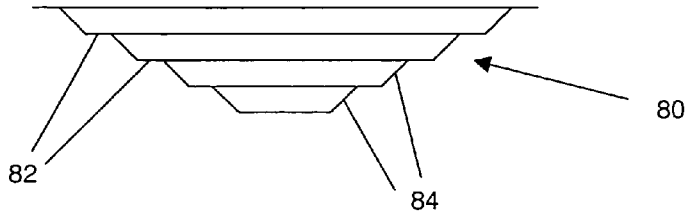
FIG. 16 is a side elevation of a seventh feeder element in accordance with the present invention.
Figure 17:
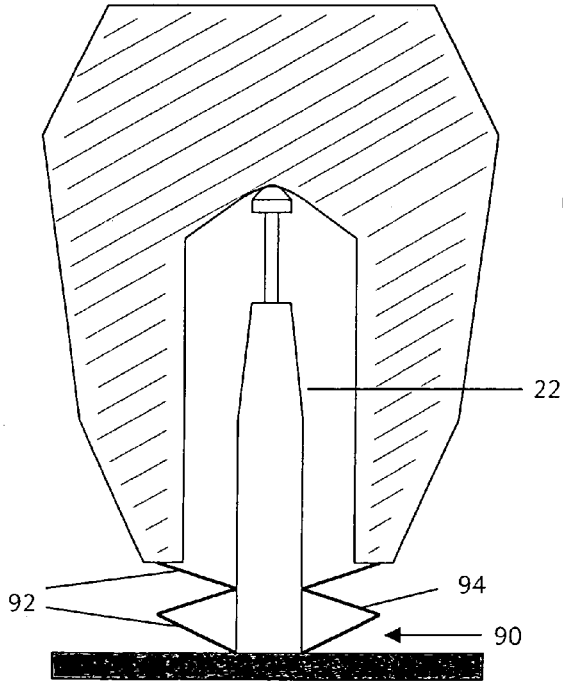
FIGS. 17 and 18 are cross sectional views of a feeder sleeve assembly incorporating an eighth embodiment of a feeder element in accordance with the present invention.
Figure 18:
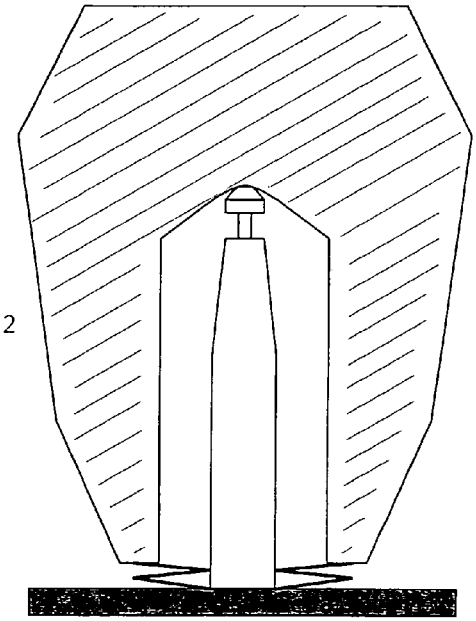

It will be understood that there are many possible breaker cores with different combinations of orientated sidewall regions. Referring to FIG. 16, the breaker core 80 illustrated is similar to that illustrated in FIG. 11. In this particular case one series of radially orientated (horizontal) sidewall regions 82 alternates with a series of axially inclined sidewall regions 84. Referring to FIGS. 17 and 18, the breaker core 90 has a zig-zag configuration formed by a first series of outwardly axially inclined sidewall regions 92 alternating with a series of inwardly axially inclined sidewall regions 94, inwardly and outwardly being defined from the base up. In this embodiment, the breaker core is mounted on the pin 22 independently of the sleeve 20, which sits on the breaker core, but is not secured thereto. In a modification (not shown) an upper radial surface defines the top of the breaker core and provides a seating surface for the sleeve which can be pre-adhered to the breaker core if required.

Figure 19:
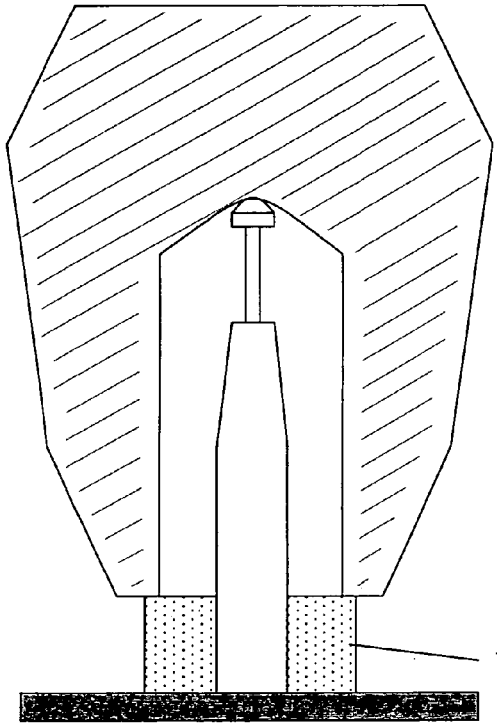
FIGS. 19 and 20 are cross-sectional schematics of a feeder assembly incorporating a ninth feeder element in accordance with the present invention before and after compression respectively.
Figure 20:
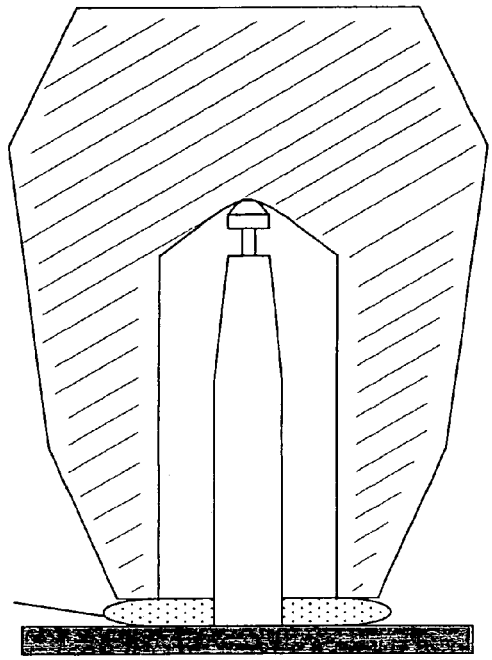

Referring to FIGS. 19 and 20, another breaker core 100 in accordance with the present invention is shown. The breaker core 100 consists simply of a tubular rubber sheath which is a sliding fit on the pin 22 and which provides a seat for the sleeve 20. Upon ram up the sheath is axially compressed (FIG. 20).

TEST EXAMPLES

Testing was conducted on a commercial Kunkel-Wagner high-pressure moulding line No 09-2958, with a ram up pressure of 300 tonnes and moulding box dimensions of 1375×975×390/390 mm. The moulding medium was a clay-bonded greensand system. The castings were central gear housings in ductile cast iron (spheroidal graphite iron) for automotive use.

COMPARATIVE EXAMPLE 1

A FEEDEX HD-VS159 feeder sleeve (fast-igniting, highly exothermic and pressure resistant) attached to a suitable silica sand breaker core (10Q) was mounted directly on the pattern plate with a fixed pin to locate the breaker core/feeder sleeve arrangement on the pattern plate prior to moulding. Although the knock off point was repeatable and close to the casting surface, damage (primarily cracking) due to the moulding pressure was evident in a number of the breaker cores and the sleeves.

COMPARATIVE EXAMPLE 2

A FEEDEX HD-VS159 feeder sleeve (fast-igniting, highly exothermic and pressure resistant) attached to a suitable locator core (50HD) was used as in comparative example 1, but in this case a spring pin was used for mounting the locator core/feeder sleeve arrangement on and above the pattern plate prior to moulding. On moulding the pressure forced down the locator core/feeder sleeve arrangement and spring pin, and moulding sand flowed under and was compacted below the locator core. No visible damage was observed in the breaker core or sleeve after moulding. However, the knock off point was not repeatable (due to the dimensions and profile of the base of the spring pins) and in some cases hand dressing of the stubs would have been required adding to the manufacturing cost of the casting.

EXAMPLE 1a

The breaker core of FIG. 1 (axial length 30 mm, minimum diameter 30 mm, maximum diameter 82 mm corresponding to the outside diameter of the base of the sleeve) manufactured from 0.5 mm steel attached to a FEEDEX HD-VS159 exothermic sleeve was mounted on either a fixed pin or a spring pin. No visible damage was observed to the feeder sleeve after moulding and it was observed that there was excellent sand compaction of the mould in the area directly below the breaker core. The knock off point was repeatable and close to the casting surface. In some cases, the residual feeder metal and breaker core actually fell off during casting shakeout from the greensand mould, obviating the need for a knock off step. There were no surface defects on the casting and no adverse implications in having the steel breaker core in direct contact with the iron casting surface.

EXAMPLE 1b

A further trial was conducted with a breaker core of FIG. 7 (axial length 33 mm, minimum diameter 20 mm, maximum diameter 82 mm corresponding to the outside diameter of the base of the sleeve) manufactured from 0.5 mm steel attached to a FEEDEX HD-VS159 exothermic sleeve. This was used for a different model design of gear housing casting with a more contoured and uneven profile to the casting in the previous example, and was similarly mounted on either a fixed pin or a spring pin. Knock off was again excellent as was sand compaction of the mould in the area directly below the breaker core. The use of this breaker core (as compared to that in Example 1a) provided the beneficial opportunity for a smaller footprint and reduced contact area of the feeder element with the casting surface.

EXAMPLE 1c

A third trial was conducted with a breaker core of FIG. 9 (axial length 28 mm, maximum diameter 82 mm corresponding to the outside diameter of the base of the sleeve and sidewall 42 tapering axially outwardly from the base at an angle of 18° to the bore axis) manufactured from 0.5 mm steel attached to a FEEDEX HD-VS159 exothermic sleeve. This was used for a number of different designs of gear housing castings including those used in examples 1a and 1b. The breaker core/feeder sleeve arrangement was mounted on either a fixed pin or a spring pin. The combination of the tapered sidewall 42 and annular flange 42*a* at the base of the breaker core resulted in a highly defined notch and taper in the feeder neck resulting in excellent knock off of the feeder head, which was highly consistent and reproducible, very close to the casting surface and thus requiring minimal machining of the stubs to produce the finished casting.

EXAMPLE 2

Investigation of Crush Strength and Sidewall Configuration

Breaker cores were tested by sitting them between the two parallel plates of a Hounsfield compression strength tester. The bottom plate was fixed, whereas the top plate traversed downwards via a mechanical screw thread mechanism at a constant rate of 30 mm per minute and graphs of force applied against plate displacement were plotted.

The breaker cores tested had the basic configuration shown in FIG. 11 (sidewall regions 12*b* and 54 being 5 mm, sidewall region 58 being 8 mm and defining a bore ranging from 18 to 25 mm, and the maximum diameter of the top 52 of the breaker core being 65 mm). In all, ten different breaker cores were tested, the only differences between the cores being angle α, which varied from 45 to 90° in 5° intervals and the length of the top outer sidewall region, which was adjusted so that the maximum diameter of the top 52 of the breaker core was 65 mm for all breaker cores. The metal thickness of the metal breaker cores was 0.6 mm.

Figure 21:
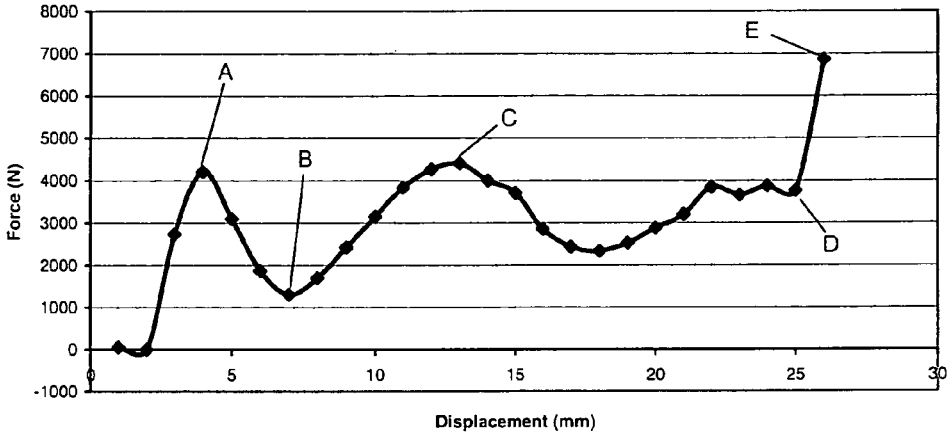
FIG. 21 is a plot of force applied against compression for the breaker core of FIG. 7.

Referring to FIG. 21, force is plotted against plate displacement for a breaker core with α=50°. It will be noted that as force is increased, there is minimal compression (associated with the natural flexibility in its unused and uncrushed state) of the breaker core until a critical force is applied (point A), referred to herein as the initial crush strength, after which compression proceeds rapidly under a lower loading, with point B marking the minimum force measurement after the initial crush strength occurs. Further compression occurs and the force increases to a maximum (maximum crush strength, point C). When the core has reached or is close to its maximum displacement (point D) the force increases rapidly off scale at the point where physically no further displacement is possible (point E).

Figure 22:
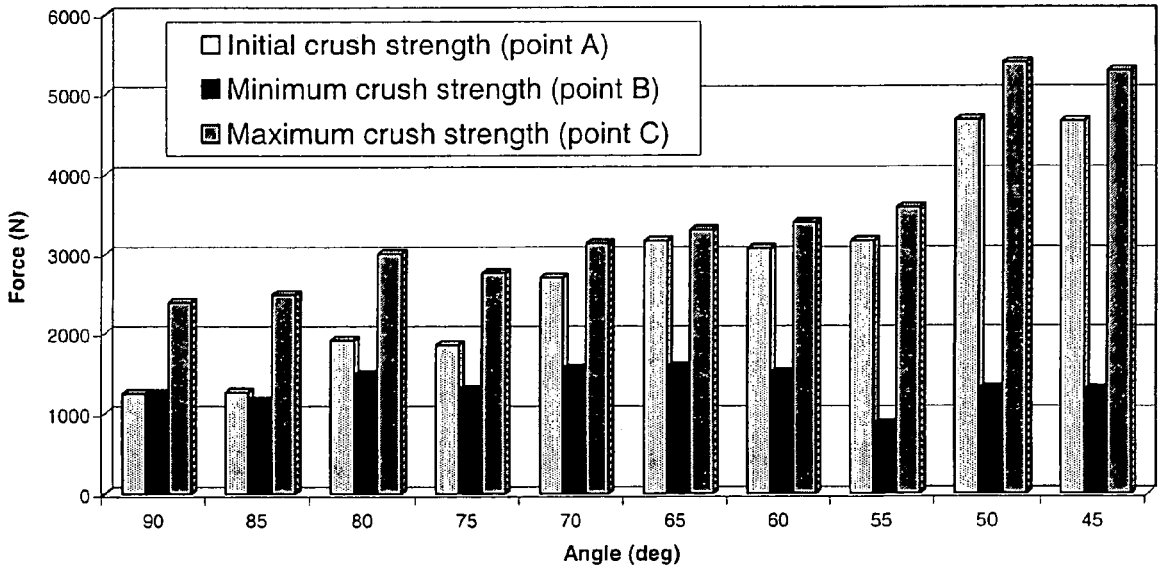
FIG. 22 is a bar chart showing compression data for a series of breaker cores in accordance with the present invention.

The initial crush strengths, minimum force measurements and maximum crush strengths are plotted in FIG. 22 for all ten breaker cores. Ideally, the initial crush strength should be lower than 3000 N. If the initial crush strength is too high then moulding pressure may cause failure of the feeder sleeve before the breaker core has a chance to compress. An ideal profile would be a linear plot from initial crush strength to maximum crush strength, therefore the minimum force measurement (point B) would ideally be very close to the minimum crush strength. The ideal maximum crush strength is very much dependent on the application for which the breaker core is intended. If very high moulding pressures are to be applied then a higher maximum crush strength would be more desirable than for a breaker core to be used in a lower moulding pressure application.

EXAMPLE 3

Investigation of Crush Strength and Sidewall Thickness

Figure 23:
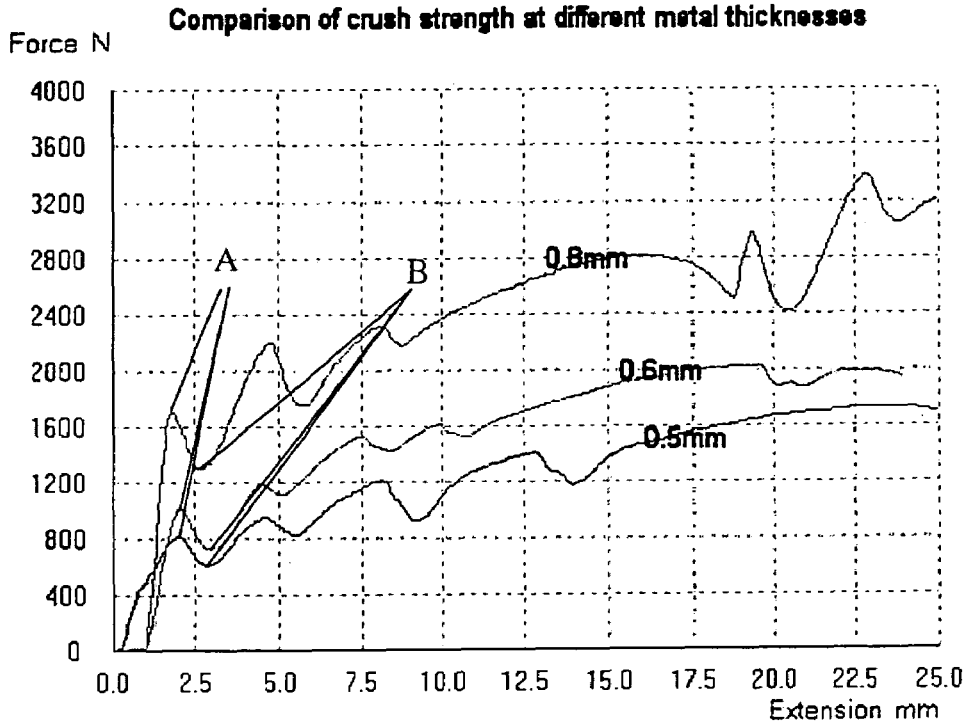
FIG. 23 is a plot of force against compression for a series of breaker cores of the type shown in FIG. 7 differing in sidewall thickness.

In order to investigate the effect of metal thickness on the crush strength parameters, further breaker cores were made and tested as for example 2. The breaker cores were identical to those used in Example 1b (axial length 33 mm, minimum diameter 20 mm, maximum diameter 82 mm corresponding to the outside diameter of the base of the sleeve). The steel thickness was 0.5, 0.6 or 0.8 mm (corresponding to 10, 12 and 16% of sidewall 12*a* annular thickness). The plots of force against displacement are shown in FIG. 23, from which it can be seen that the initial crush strength (points A) increases with metal thickness, as does the difference between the minimum force (points B) and the initial crush strength. If the metal is too thick relative to the sidewall region 12*a* annular thickness, then the initial crush strength is unacceptably high. If the metal is too thin, then the crush strength is unacceptably low.

It will be understood from a consideration of Examples 2 and 3, that by changing the geometry of the breaker core and the thickness of the breaker core material, the three key parameters (initial crush strength, minimum force and maximum crush strength) can be tailored to the particular application intended for the breaker core.

The invention claimed is:

1. A feeder element for use in metal casting, said feeder element having a first end for mounting on a mould pattern, an opposite second end for receiving a feeder sleeve and a bore between the first and second ends defined by a stepped sidewall which comprises a first series of sidewall regions in the form of rings of increasing diameter interconnected and integrally formed with a second series of sidewall regions, said feeder element being irreversibly compressible in use whereby to reduce the distance between said first and second ends, wherein an initial crush strength in response to a force applied between the first and second ends is no more than 5000 N.

2. A feeder element as claimed in claim 1, wherein the initial crush strength is at least 500 N.

3. A feeder element as claimed in claim 1, wherein compression is achieved through the deformation of a non-brittle material.

4. A feeder element as claimed in claim 1, wherein said rings are circular.

5. A feeder element as claimed in claim 1, wherein said rings are planar.

6. A feeder element as claimed in claim 1, wherein the sidewall regions are of substantially uniform thickness, so that the diameter of the bore of the feeder element increases from the first end to the second end of the feeder element.

7. A feeder element as claimed in claim 1, wherein the second series of sidewall regions are parallel to the bore axis.

8. A feeder element as claimed in claim 1, wherein the angle defined between the bore axis and the first sidewall regions is from about 55 to 90°.

9. A feeder element as claimed in claim 1, wherein the sidewall region defining the first end of the feeder element is inclined to the bore axis by an angle of 5 to 30°.

10. A feeder element as claimed in claim 1, wherein the thickness of the sidewall regions is from about 4 to 24% of the distance between the inner and outer diameters of the first sidewall regions.

11. A feeder element as claimed in claim 10, wherein a free edge of the sidewall region defining the first end of the feeder element has an inwardly directed annular flange.

12. A feeder element as claimed in claim 1, wherein the sidewall of the feeder element is provided with one or more weak points which are designed to deform or shear in use under a predetermined load.

13. A feeder element as claimed in claim 12, wherein the sidewall is provided with at least one region of reduced thickness which deforms under a predetermined load.

14. A feeder element as claimed in claim 12, wherein the sidewall is provided with one or more kinks, bends, or corrugations which cause the sidewall to deform under a predetermined load.

15. A feeder element as claimed in claim 12, wherein the bore is frustoconical and bounded by a sidewall having at least one circumferential groove.

16. A feeder element as claimed in claim 1 wherein the feeder element is made from a metal selected from steel, aluminum, aluminum alloys and brass.

17. A feeder element as claimed in claim 1 wherein the feeder element is made from steel.

18. A feeder element as claimed in claim 1 wherein the crush strength is at least 500 N and no more than 3000 N.

19. A feeder as claimed in claim 1 wherein the thickness of the sidewall regions is 0.4 to 1.5 mm.

20. A feeder system for metal casting comprising a feeder element and a feeder sleeve said feeder element having a first end for mounting on a mould pattern, an opposite second end to which the feeder sleeve is secured and a bore between the first and second ends, said feeder sleeve having an opening at one end thereof in communication with the bore of the feeder element, said feeder sleeve being secured to the second end of the feeder element at said one end of the feeder sleeve, wherein the feeder element is irreversibly compressible in use whereby to reduce the distance between said first and second ends, and wherein an initial crush strength of the feeder element in response to a force applied in a direction of the bore axis is no more than 5000 N.

21. A feeder system in accordance with claim 20, in which the feeder sleeve is secured to the feeder element by adhesive or by being a push fit with the feeder element or by moulding the sleeve around part of the feeder element.

22. A method of forming one part of a casting mould, said method comprising, providing a mould pattern and a feeder system, said feeder system comprising a feeder sleeve and a feeder element, wherein the feeder element has a first end and an opposite second end and a bore between the first and second ends defined by a sidewall, the feeder sleeve having an opening at one end thereof in communication with the bore of the feeder element, said feeder sleeve being secured to the feeder element at the second end of the feeder element such that a flowpath exists through the bore and into the feeder sleeve, the feeder element having an initial crush strength of no more than 5000 N measured along the bore axis;

mounting the first end of the feeder element on the mould pattern;

pouring sufficient moulding sand onto the mould pattern to cover the feeder sleeve; and applying a compressive force to the moulding sand in the general direction of the bore axis of the feeder element, such that the sand compacts and the feeder element compresses irreversibly whereby the distance between the first and second ends of the feeder element is reduced.

* * * * *